US006604402B2

(12) United States Patent
Arai et al.

(10) Patent No.: US 6,604,402 B2
(45) Date of Patent: Aug. 12, 2003

(54) TRANSFER DEVICE FOR A PRESS

(75) Inventors: Toshihiko Arai, Kanagawa-ken (JP); Nobuyoshi Maeda, Kanagawa-ken (JP); Toshihiko Nobuoka, Tokyo (JP)

(73) Assignee: Aida Engineering Co., Ltd., Kanagawa (JP)

( * ) Notice: Subject to any disclaimer, the term of this patent is extended or adjusted under 35 U.S.C. 154(b) by 0 days.

(21) Appl. No.: 09/950,480

(22) Filed: Sep. 10, 2001

(65) Prior Publication Data

US 2002/0038606 A1 Apr. 4, 2002

(30) Foreign Application Priority Data

Sep. 29, 2000 (JP) ..... 2000-300204

(51) Int. Cl.[7] ..... B21D 43/05

(52) U.S. Cl. ..... 72/405.13; 72/405.11; 198/621.1

(58) Field of Search ..... 72/405.01, 405.13, 72/405.11, 405.12, 405.1, 405.16; 198/621.1

(56) References Cited

U.S. PATENT DOCUMENTS

| | | | | | |
|---|---|---|---|---|---|
| 3,746,184 | A | * | 7/1973 | Wallis | 72/405.13 |
| 4,589,819 | A | * | 5/1986 | Shirao | 72/405.12 |
| 4,811,834 | A | * | 3/1989 | Asano et al. | 72/405.13 |
| 5,640,875 | A | * | 6/1997 | Horde et al. | 72/405.13 |
| 5,680,787 | A | * | 10/1997 | Fisch | 72/405.16 |
| 5,690,026 | A | * | 11/1997 | Thudium et al. | 72/405.16 |
| 5,899,109 | A | * | 5/1999 | Fisch | 72/405.16 |
| 6,105,414 | A | * | 8/2000 | Yamada et al. | 72/405.16 |

* cited by examiner

*Primary Examiner*—Daniel C. Crane
(74) *Attorney, Agent, or Firm*—Darby & Darby

(57) ABSTRACT

A transfer device combines an advance-return drive mechanism and a clamp-unclamp drive mechanism. The transfer device operates from only one side of a press to position both drive mechanisms above a pair of feed bars thereby greatly reducing spatial constraints and costs and enabling an increase in speed. The feed bars operate to process a work piece along a process direction. The feed bars are cantilevered from the transfer device for easy use with a press, raw materials feeder, and product gatherer.

21 Claims, 4 Drawing Sheets

TRANSFER DEVICE FOR A PRESS

BACKGROUND OF THE INVENTION

1. Field of the Invention

The present invention relates to a transfer device for a press having multiple processing stages. More specifically, the present invention relates to a transfer device that conducts progressive processing on an upstream side, separates a product from a product skeleton on the way, and thereafter conducts transfer processing on a downstream side.

2. Description of the Related Art

In recent years, productivity improvements have required pressing and processing increasingly complex shapes. Additionally, manufacturers have demanded increased precision, reduced up-front equipment costs, increased processing speed, and reduced installation and operation space.

As one example of this demand, a plurality of processing steps are now frequently required for a single press. In this example, a production format calls for progressive processing on an upstream side and transfer processing on a downstream side. In this production format, a general transfer device is often used since only the transfer process is conducted with great frequency. In this type of general transfer device, a unit case houses a drive mechanism module for feed bars installed on both sides of the press. In this type of general transfer device, the unit cases that control the feed bars are installed below the feed bars creating transfer problems.

Where transfer processing frequency is low and progressive processing frequency is high, the above described general transfer device of the prior art is inadequate. Here, when a unit case is installed on an upstream side surface of the press, the distance from a material supply opening of a coil feeder to a first processing stage is long. This type of construction results in increased waste after processing is conduced. The increased waste increases costs.

Further, the long distance reduces feeding precision and negatively effects processing precision. This construction requests unit cases provided on each side of the processing area and necessitates speciality manufacturing, thus increasing costs.

Finally, since the unit cases are installed below the feed bars, space for conveyor equipment, product removal equipment, and a product receiving equipment is reduced.

OBJECTS AND SUMMARY OF THE PRESENT INVENTION

It is an object of the present invention to provide a transfer device with improved productivity, reduced installation space, and reduced costs of production and purchase.

It is another object of the present invention to provide a transfer device with a unit case positioned above feed bars to increase space availability, speed processing, and reduce waste.

It is another object of the present invention to provide a transfer device with a unit case on only one side of a press to increase space, reduce costs, and increase supply and process precision.

It is another object of the present invention to provide a transfer device with feed bars supported on only one side.

It is another object of the present invention to provide a transfer device with a unit case that internalizes and protects a drive mechanism module.

It is another object of the present invention to provide a transfer device that easily accommodates a removal conveyor.

It is another object of the present invention to provide a transfer device that includes a drive mechanism combining an advance-return drive mechanism and a clamp-unclamp drive mechanism.

It is another object of the present invention to provide a transfer device that accommodates a safety sensor to prevent damage to the device upon an error in transfer.

Briefly stated, the present invention relates to a transfer device that combines an advance-return drive mechanism and a clamp-unclamp drive mechanism. The transfer device operates from only one side of a press and positions both drive mechanisms above a pair of feed bars greatly reducing all spacial constraints and costs. The feed bars operate to process a work piece along a process direction. The feed bars cantilever from the transfer device for easy use with a press and raw materials feeder or product gatherer.

According to an embodiment of the present invention, there is provided, a transfer device, conducting multiple processing steps along a process direction of a press, comprising: means for driving the transfer device, means for feeding an external workpiece along the process direction, the feeding means cantilevered from one side of the driving means, the feeding means below the driving means, the driving means including a first and second operating means, the first operating means controlling the feeding means along the processing direction, a second operating means controlling feeding means perpendicular to the processing direction, and the first and second operating means operating together whereby the transfer device processes the external workpiece from an upstream side to a downstream side and is simplified and reduced in cost and size.

According to another embodiment of the present invention, there is provided, a transfer device wherein: the driving means operates on a first side of the press, the feeding means extends below the driving means, the first operating means controls the feeding means in an advance-return motion, and the second operating means controls the feeding means in a clamp-unclamp motion.

According to another embodiment of the present invention, there is provided, a transfer device, further comprising: slider means for slidably directing the feed bars in the advance-return motion.

According to another embodiment of the present invention, there is provided a transfer device, further comprising: a bushing, a nut, and a slider on the slider means, the slider and the bushing perpendicular to the feeding means, at least one guide shaft slidably supporting the bushing and the slider in the advance-return motion, a first ball screw shaft extending parallel to the feed bars, the nut threadably engaging the first ball screw shaft, a first drive source rotatably engages the first ball screw shaft, and the nut rotatively controls the slider in the advance-return motion whereby the external work piece processes along the process direction.

According to another embodiment of the present invention, there is provided a transfer device, further comprising: cart means for slidably supporting the feeding means in the advance return motion and conducting the clamp-unclamp motion whereby the external work piece processes along the process direction.

According to another embodiment of the present invention, there is provided a transfer device, further comprising: at least first and second carts in the cart means, a second ball screw shaft extending perpendicular to the feeding means between the first and second carts, the second ball screw shaft being reverse threaded at a midpoint to the process direction, a second nut on each cart, each second nut threadably engaging the second ball screw shaft, and a second drive source rotatably engaging the second ball screw shaft and rotatably controlling each cart and the feeding means in the clamp-unclamp motion whereby the external work piece processes along the process direction.

According to another embodiment of the present invention, there is provided a transfer device further comprising: an end plate affixed to an inside portion of each the cart, a spring resiliently retained between each second nut and each end plate, the second ball screw shaft extending through each end plate and each spring, a first bracket affixed to the cart opposite each end plate, and the springs providing a spring force through the second nut to the first bracket whereby the spring resiliently urges the second nut against the first bracket.

According to another embodiment of the present invention, there is provided a transfer device, further comprising: sensor means for detecting a separation between the first bracket and the second nut, control means for controlling the press and the transfer device, the sensor means producing a signal to the control means on the separation, and the control means detecting the signal and stopping the press and the transfer device whereby damage to the drive mechanism and the feed bars is eliminated and costs are reduced.

According to another embodiment of the present invention, there is provided a transfer device, further comprising: sensor means for detecting a failure to operate the feeding means, control means for controlling the press and the transfer device, the sensor means producing a signal to the control means on the failure to operate, and the control means detecting the signal and stopping the press and the transfer device whereby damage to the driving means and the feeding means is eliminated and costs are reduced.

According to another embodiment of the present invention, there is provided a transfer device, conducting multiple processing steps along a process direction of a press, comprising: a drive mechanism having a case, a pair of feed bars cantilevered from one side of the drive mechanism, the feed bars cantilevered in the processing direction, the feed bars extending below drive means, the drive mechanism including a first and second operating means, the first operating means operating the feed bars along the processing direction in an advance-return motion, a second operating means operating the feed bars perpendicular to the processing direction in a clamp-unclamp motion, and the drive mechanism on a first side of the press and driving the first and second operating means whereby the feed bars processes an external workpiece along the processing direction and the transfer device is simplified and reduced in size.

According to another embodiment of the present invention, there is provided a transfer device, further comprising: a slider slidably supporting the feed bars in the advance-return motion, the slider including a bushing and a nut, the slider and the bushing perpendicular to the feed bars, at least one guide shaft slidably supporting the bushing and the slider in the advance-return motion, a first ball screw shaft extending parallel to the feed bars, the nut threadably engaging the first ball screw shaft, a first drive source rotatably engages the first ball screw shaft and the nut rotatively controls the slider in the advance-return motion whereby the external work piece processes along the process direction.

According to another embodiment of the present invention, there is provided a transfer device, further comprising: a cart slidably supports each feed bar in the advance-return motion, a second ball screw shaft extending perpendicular to the feed bars to each cart, the second ball screw shaft being reverse threaded at a midpoint to the process direction, a second nut on each cart, the second nuts threadably engaging the second ball screw shaft, and a second drive source rotatably engages the second ball screw shaft and the second nuts rotatably control the carts and the feed bars in the clamp-unclamp motion whereby the external work piece processes along the process direction.

According to another embodiment of the present invention, there is provided a transfer device, further comprising: an end plate affixed to an inside portion of each cart, a spring resiliently retained between each second nut and each end plate, the second ball screw shaft extending through each end plate and each spring, a first bracket affixed to the cart opposite each end plate, and the springs urging a spring force through the second nut to the first bracket whereby the second nut is resiliently urged against the first bracket.

According to another embodiment of the present invention, there is provided a transfer device, further comprising: a sensor, a control means for controlling the press and the transfer device, the sensor detecting a separation between the first bracket and the second nut, the sensor producing a signal to the control means on the separation, and the control means detecting the signal and stopping the press and the transfer device whereby damage to the drive mechanism and the feed bars is eliminated and costs are reduced.

According to another embodiment of the present invention, there is provided a transfer device, for use in press that conducts pressing by a plurality of processing steps along a feed direction, comprising: a pair of feed bars extending parallel to a feed direction, a drive module, the drive module being of a type that drives the feed bars to conduct transporting motions of a workpiece, the drive module being of a type that supports one end of the feed bars, a unit case that internalizes the drive mechanism module, the unit case on one side surface of the press, and the unit case above the feed bars whereby the transfer device is made smaller, at a reduced cost, while increasing precision and efficiency.

According to another embodiment of the present invention, there is provided a transfer device, further comprising: the drive module includes an advance-return drive module and a clamp-unclamp drive module, the advance-return drive module being of a type operating the feed bars along the feed direction, the clamp-unclamp drive module being of a type operating the feed bars perpendicular to the feed direction, and the drive module coordinating the advance-return drive module and the clamp-unclamp drive module whereby transfer device moves an external work piece along the feed direction.

According to another embodiment of the present invention, there is provided a transfer device, further comprising: a slider that slidably supports the feed bars in the feed direction, a bushing on the slider, a guide shaft slidably joined to the bushing and the slider, the guide shaft slidably supports the slider along the feed direction, a first ball screw shaft, a first nut on the slider, the first nut threadably engages the first ball screw shaft, and a first drive source rotatably controlling the first ball screw shaft and the slider whereby the advance-return drive module operates and transfers the external work piece along the feed direction.

According to another embodiment of the present invention, there is provided a transfer device, further comprising: at least one cart, the cart slidably supports each the feed bars along the feed direction, a second nut operably attached to each the cart, a second ball screw shaft perpendicular to the feed direction, the second ball screw shaft threadably engages each the second nut, the second ball screw shaft reverse threaded about a center line of the feed direction, and a second drive source rotatably controlling the second ball screw shaft and each cart whereby the clamp-unclamp module operates and transfers the external work piece along the feed direction.

According to another embodiment of the present invention, there is provided a transfer device, further comprising: an end plate, the end plate affixed to each the cart, a spring on the second ball screw shaft, the spring resiliently retained on between the each end plate and each the second nut, a bracket, the bracket affixed opposite the end plate on the cart, the springs resiliently urging each second nut against each bracket, and a sensor being of a type that detects a separation of the second nut from the bracket and sends a signal that stops the transfer device and the press whereby the transfer device and the press are protected from damage.

According to another embodiment of the present invention, there is provided a transfer device, wherein: a coil feeder is on an upstream side of the press, the transfer device is on a downstream side of the press, and the transfer device progressively transfers an external work piece from the coil feeder through the press to an offload station whereby the transfer device increases operational precision, minimizes operational costs, reduces the equipment size, and reduces waste material.

The above, and other objects, features, and advantages of the present invention will become apparent from the following description read in conjunction with the accompanying drawings, in which like reference numerals designate the same elements.

DESCRIPTION OF THE PREFERRED EMBODIMENTS

Figure 1:
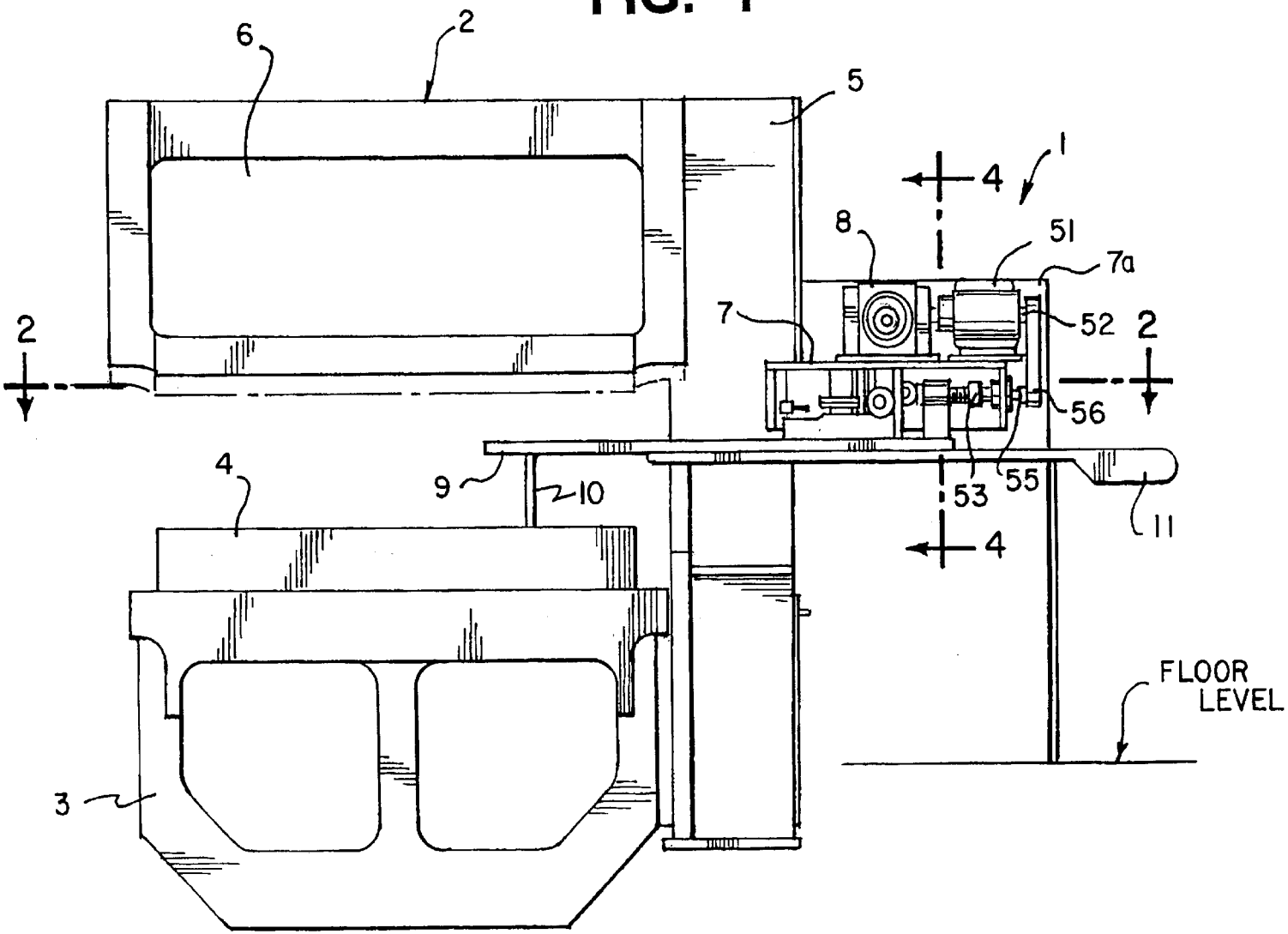
FIG. 1 is a front view of an embodiment of the present invention.
Figure 2:
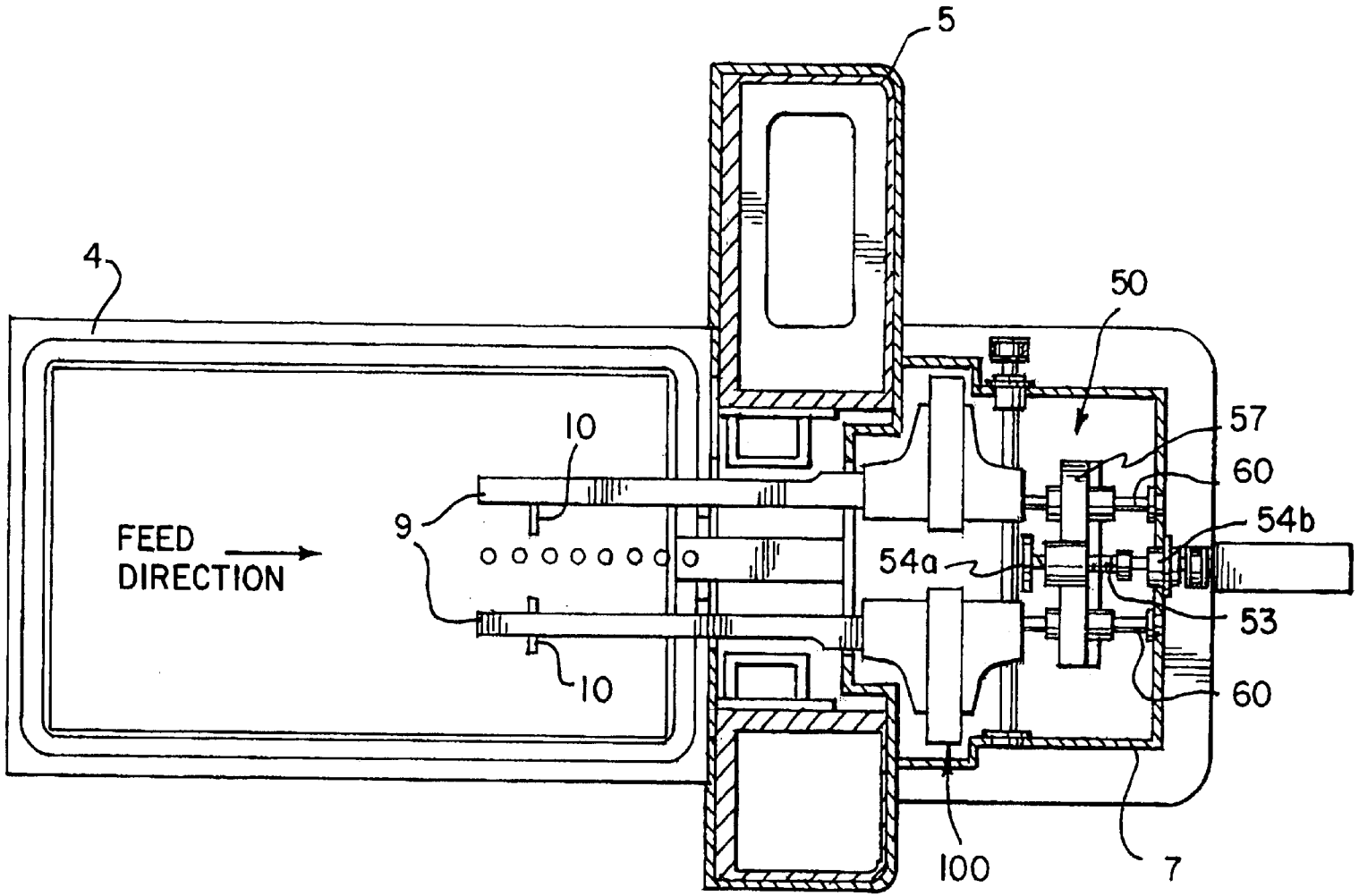
FIG. 2 is cross-section along line 2—2 of FIG. 1.

Referring to FIGS. 1 and 2, a press 2 includes a bed 3 and a bolster 4, opposite a slide 6. A portion of a column 5 guides a slide 6 during operation. A transfer device 1 is positioned at one side of press 2.

During operation, a die (not shown) is positioned between slide 6 and bolster 4. A coil feeder (not shown) is positioned on the opposite side of press 2 from transfer device 1. The coil feeder provides raw material for processing.

The die includes multiple processing steps. Progressive processing is conducted on an upstream side and transfer processing is conducted on a downstream side. In operation, the supplied coil material is progressively processed on the upstream side to an intermediate step, where a product and skeleton are separated, and the product is thereafter transfer processed on the downstream side.

A conveyor 11 is positioned below transfer device 1. In a final processing step, a product is placed on top of conveyor 11. Conveyor 11 moves the product to the outside of press 2 for removal and later processing.

A unit case 7 is on one side (right shown) of press 2. A drive mechanism module 8 is internalized in unit case 7. Drive mechanism module 8 actuates a pair of feed bars 9. Drive mechanism module 8 includes an advance return drive mechanism module 50 that drives feed bars 9 in an advance-return motion. Drive mechanism module 8 also includes a clamp-unclamp drive mechanism module 100 that drives feed bars 9 in a clamp-unclamp motion.

A cover 7*a* is on unit case 7. Feed bars 9 extend in a cantilever manner from transfer device 1. Receiving stands 10 may be optionally provided to support the ends of feed bars 9 but are not required in a preferred embodiment. Receiving stands 10 are not required for operation but may be included to provide additional security and support in heavy operating situations.

A servo motor 51 is on top of unit case 7. Servo motor 51 is a drive source for advance return drive mechanism module 50. A pulley 52 is provided on a drive shaft of servo motor 51.

A ball screw shaft 53 is in unit case 7. Ball screw shaft 53 is parallel with the advance-return direction (to the left-right in FIGS. 1 and 2). Ball screw shaft 53 is supported by a bearing 54*a* and a bearing 54*b* provided on unit case 7.

A pulley 55 is affixed to one end of ball screw shaft 53. A belt 56 connects pulley 55 to pulley 52. A drive force of servo motor 51 is transferred to ball screw shaft 53 by belt 56 and pulleys 52, 55. A slider 57 is included in advance return drive mechanism module 50.

Two guide shafts 60 are in unit case 7 parallel to the advance and return direction of feed bars 9, as will be explained.

Figure 3:
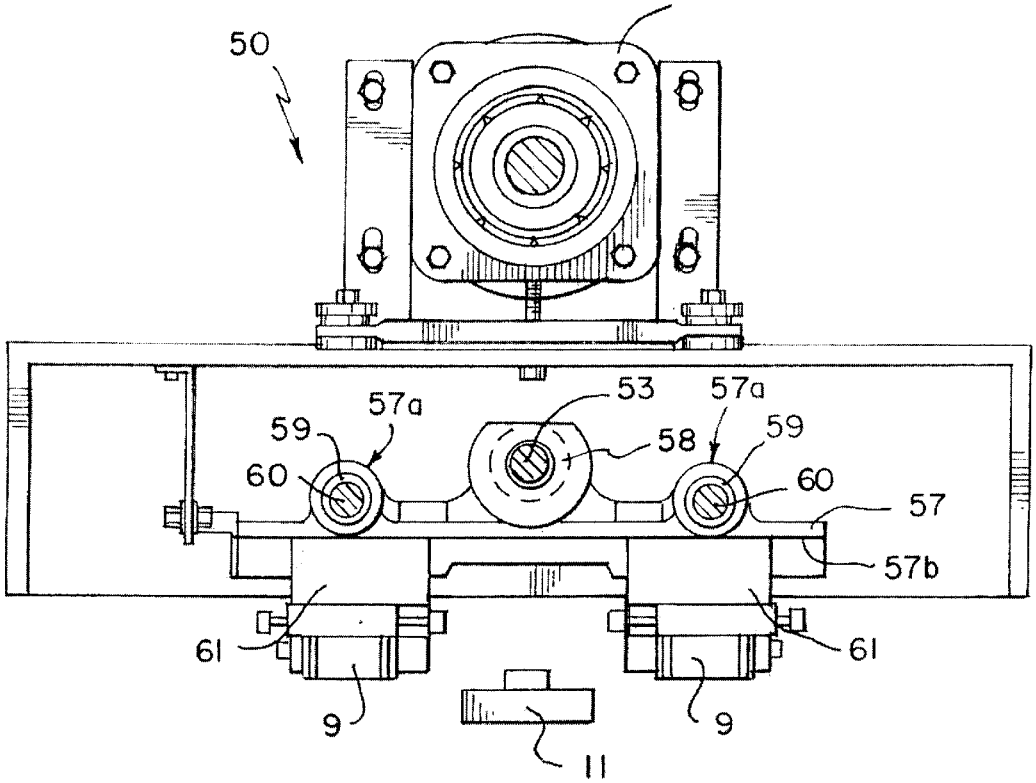
FIG. 3 is a right side view of FIG. 1.

Additionally referring now to FIG. 3, a nut 58 is affixed to the center of an upper part of slider 57. Nut 58 and ball screw shaft 53 are screwed together. A guide module 57*a* and a guide module 57*a* are on both sides of nut 58. Guide modules 57*a* include a central hole (not shown). A bushing 59 and a bushing 59 are in the central holes passing through guide modules 57*a*.

Guide shafts 60 are parallel to the direction of advance and return movement in unit case 7 and serve to guide bushings 59 and guide parts 57*a* during operation. Bushings 59, in guide parts 57*a*, are slidably joined to guide shafts 60. It should be understood, that additional guide shafts 60, and operating elements may be provided depending upon manufacturer need and processing demand.

A groove 57*b* is on a lower part of slider 57, in parallel with the clamp-unclamp direction. Lower parts of a pair of holders 61 operably affix the ends of feed bars 9. The upper parts of holders 61 are slidably supported in the clamp-unclamp direction by groove 57*b*.

Figure 4:
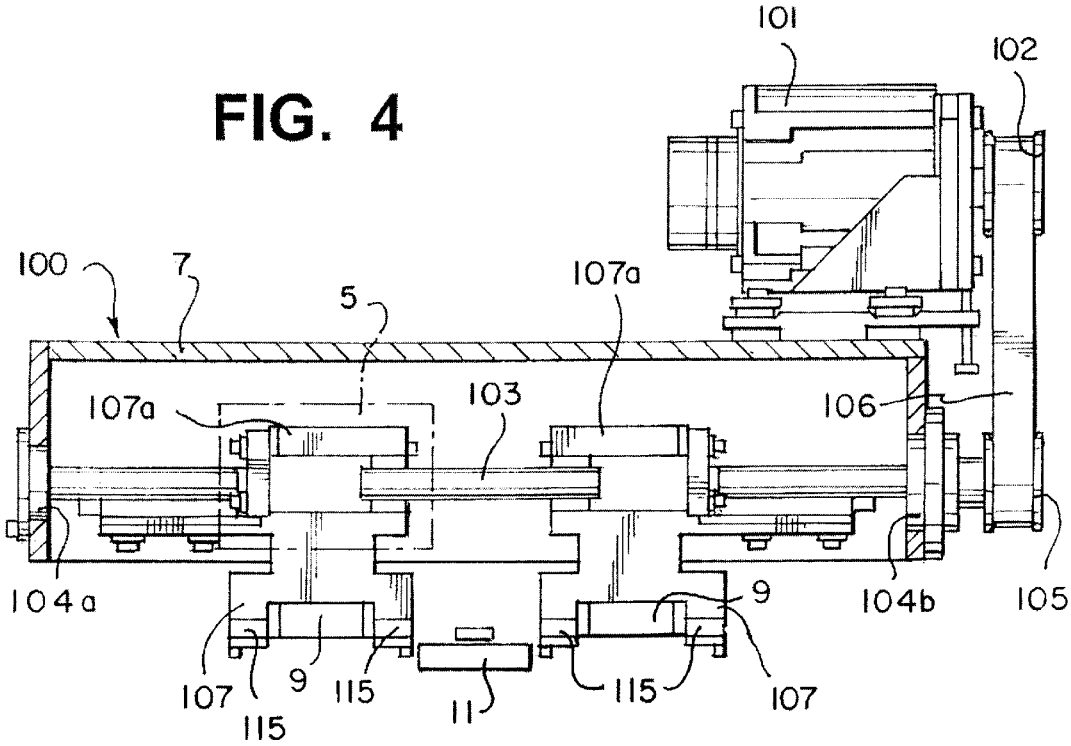
FIG. 4 is a cross-section along line 4—4 of FIG. 1.

Additionally referring to FIG. 4, a servo motor 101 is on a top portion of unit case 7. Servo motor 101 serves as a drive source for clamp-unclamp drive mechanism 100. A pulley 102 is on a drive shaft of servo motor 101.

A ball screw shaft 103 is in unit case 7 in a direction parallel to the clamp-unclamp direction. Ball screw shaft 103 is operably supported on both ends by a bearing 104*a* and a bearing 104*b*. A pulley 105 is on one end of ball screw shaft 103. A belt 106 connects pulley 105 and pulley 102. Belt 106 transmits the drive force of servo motor 101 to ball screw shaft 103. The direction of threading on ball screw shaft 103 changes to an opposite direction at a midpoint to the feed direction shown in FIG. 2 and assists the clamp-unclamp operation, as will be explained.

Carts 107 are on clamp-unclamp drive mechanism module 100. Joining parts 107*a* are on an upper part of carts 107. Joining parts 107*a* include a through hole. Cam followers 115 are on a lower parts of cars 107. Cam followers 115 guide feed bars 9 in the advance-return direction, as will be explained.

Figure 5:
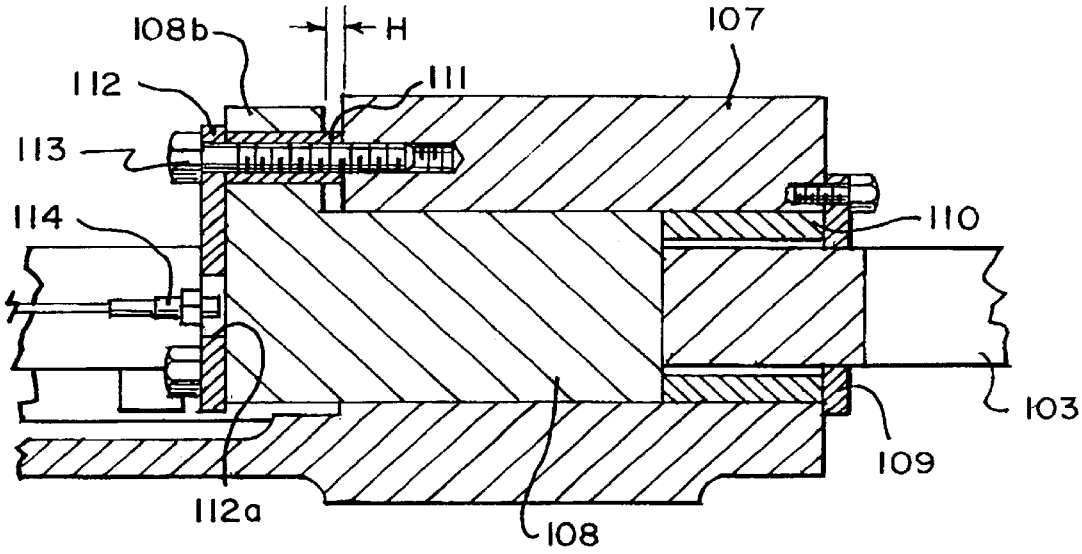
FIG. 5 is a detailed drawing of a section of FIG. 4.

Additionally referring now to FIG. 5, a nuts 108 and ball screw shaft 103 are screwed together. Nuts 108 slidably join with the hole in joining parts 107*a*.

A pair of springs 110 are provided between nuts 108 and end plates 109. End plates 109 are affixed to the side surface of the inner side of joining parts 107*a*. Brackets 112 are affixed on the side surface of the outer side of joining parts 107*a*, by spacers 111. Spacers 111 are hollow, as will be explained.

Spacers 111 pass through holes 108*b* on flange parts 108*a* of nuts 108. Bolts 113, tighten and sandwich spacers 111 between the side surface of the outside of carts 107 and brackets 112. Holes 108*b* have an inside diameter slightly larger than the diameter of spacers 111 to allow operation of a safety sensor, as will be explained. Bolts 113 are inserted in spacers 111 and placed in a radiating manner.

The extending spring force of springs 110 maintains contact between the side surfaces on the outside of flange parts 108*a* of nuts 108 are in contact with brackets 112. It is to be understood, that the outward movement of nuts 108 is restricted by brackets 112. Springs 110 are compressed between nuts 108 and end plates 109.

At least one sensor 114 is affixed to brackets 112. In the present embodiment, multiple sensors 114 are proximity switches. Holes 112*a* are on brackets 112 and accommodate sensors 114. Sensors 114 measure the distance from sensors 114 to the surface where flange parts 108*a* contact brackets 112.

The movement of nuts 108, defined as flange parts 108*a* separating from brackets 112, can be detected by sensors 114. It is to be understood, that as long as sensors 114 can detect the movement of nuts 108 the specific type or position of sensor 114 is not critical.

It is to be understood that in advance-return mechanism module 50, during advance-return motion, ball screw shaft 53 rotates via belt 56 in a direction dictated by servo motor 51. Thereupon, nut 58 moves in the direction indicated, and, slider 57 also moves along guide shaft 60 in the same direction. Holders 61 move in a similar manner. Feed bars 9 conduct an advancing motion (or a returning motion). During the advance or retreat motion, cam followers 115, on the lower parts of carts 107 guide feed bars 9.

It is to be understood that in clamp-unclamp mechanism module 100, during clamp-unclamp motion, ball screw shaft 103 rotates via belt 106 in a direction controlled by servo motor 101. Since the direction of the threading on ball screw shaft 103 changes at the midpoint in the feed direction, nuts 108 move closer to each other. In the opposite direction, nuts 108 move further away from each other. The motion of nuts 108 dictates the motion of carts 107. Feed bars 9 are fixed in the clamp-unclamp direction by cam followers 115. As a result, feed bars 9 conduct a clamping or unclamping motion. In parallel with the this motion, holders 61 also move relative to each other along groove 57*b*.

With the above construction and motions, transfer device 1 can transport a workpiece through a work process. In the present invention, the advance-return motion and the clamp-unclamp motion are combined to securely transport a work piece from an upstream to a downstream side of a work process.

In the clamp motion described above, the workpiece is gripped, and the feed bars are advanced, and the workpiece is transported one pitch distance. By the unclamping motion, the workpiece is released and is pressed. The feed bars are then returned to their original positions. This series of clamp-unclamp motions is repeated throughout the process.

It is to be understood that the present invention may transport work pieces of variable weight and size. Feed bars 9 are designed to accommodate generous sizes and shapes. Holders 61 operate to support feed bars 9 during regular operation. If holders 61 cannot support feed bars 9, by reason of work piece weight, it may be beneficial to the process to additionally provide receiving stands 10 upon customer request. Receiving stands extend from a top of bolster 4 below the area near the end of feed bars 9. Receiving stands 10 slidably support the ends of feed bars 9.

It is to be understood, that the length of feed bars 9 is shown at an intermediate point in the die area. During normal operation a coil feeder (not shown) or other feeder is on the upstream side of transfer device 1. Progressive processing is conducted on the upstream side, and transfer processing is conducted on the downstream side.

With the current transfer device 1, since there is no second unit case 7 on the upstream side, the distance from a material supply opening, from a coil feeder to the die area is shortened. As a result, the amount of residual material at completion of processing is reduced. Further, the shortened supply distance enables precise materials supply.

Furthermore, because space is available below unit case 7, the removal of the product can also be conducted easily by placing product removal conveyor 11 below unit case 7. This enables close association between transfer device 1 and conveyor 11 and further reduces the equipment footprint. This reduction in footprint means that more presses 2 may be positioned close together and small floor space utilized for the same output.

During a clamping motion, a foreign object may be inappropriately positioned between feed bars 9. This situation most frequently occurs during die adjustment when feed bars 9 or fingers (not shown) on feed bars 9 contact the dies. This situation may also occur where a product is in appropriately misplaced in transfer device 1.

Where a foreign object is between feed bars 9, feed bars 9 can no longer move. As a result, carts 107 can no longer move. However, since servo motor 101 continues to operate, ball screw shaft 103 tries to rotate. Due to the rotation of ball screw shaft 103, nuts 108 try to move closer to each other. Because carts 107 do not move, only nuts 108 move opposing the expanding force of springs 110 that are trying to extend.

Thereupon, the surface, where flange parts 108*a* contact brackets 112, separates from brackets 112. A distance H is defined as the distance nuts 108 move when a foreign object blocks the movement of carts 107. Distance H is detected by sensors 114 that generate a detection signal. The detection signal is sent to a control device (not shown) of transfer device 1 and press 2. The control device immediately stops transfer device 1 and press 2. As a result, damage is the mechanical structures of transfer device 1, particularly drive mechanism module 8 and feed bars 9, is prevented.

It is to be understood, that through the combination of reduced equipment needs and reduced failure rates, equipment costs are greatly reduced. Specifically, compared to related art, the manufacturing cost of unit case 7, attachment stays, other equipment, and failure losses is halved. This is a surprising result since total costs are seldom so dramatically reduceable.

It is to be further understood that since unit case 7 is positioned above feed bars 9, a product removal conveyor 11 or product removal by loading of the products by a bucket or cart is easily conducted. The simplified removal further increased final product precision and reduces failure rates by enabling quick removal of the final product and any residual material in press 2.

It is to be further understood that the simplified transfer device 1 of the present invention is only one side of press 2, it greatly reduces overall size, eases repairs, and increases precision without any of the detractions of the related art described above. This great reduction in size, ease of repair and increase of precision is additionally surprising.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims. In the claims, means-plus-function clauses are intended to cover the structures described or suggested herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A transfer device for a press machine, comprising:

a first module in said transfer device;

a second module in said transfer device;

driving means for driving said first and said second modules in a sequence with said press machine;

feeding means for feeding an external workpiece along a process direction of said press machine;

said feeding means extending from a bottom side of said driving means;

said feeding means cantilevered from a single side of said driving means;

said first module operating said feeding means along said process direction;

said second module operating said feeding means perpendicular to said process direction;

at least a first pair of feed bars in said feeding means, wherein said pair feed bars being operably connected to said first and said second module; and said driving means operating said first and second modules in said sequence to transport said external workpiece along said process direction whereby a speed of said transfer device increases and said transfer device is simplified and reduced in cost and size.

2. A transfer device, according to claim 1, wherein:

said driving means is disposed on a first side of said press machine;

said first module operates said feeding means in a reciprocating advance-return motion along said process direction; and said second module operates said feeding means in a clamp-unclamp motion perpendicular to said process direction.

3. A transfer device according to claim 2, further comprising: a slider means for slidably directing said feeding means in said advance-return motion.

4. A transfer device according to claim 3, further comprising:

cart means for slidably supporting said feeding means;

said cart mean permitting slidable support of said first pair of feed bars during said advance return motion and conducting said clamp-unclamp motion whereby said external work piece processes along said process direction.

5. A transfer device according to claim 4, further comprising:

sensor means for sensing and detecting a failure to properly operate said feeding means;

controlling means for controlling said press and said transfer device;

said sensor means producing a signal to said controlling means upon said failure to operate; and said controlling means detecting said signal and stopping said press and said transfer device whereby damage to said driving means and said feeding means is eliminated and costs are reduced.

6. A transfer device for a press machine, comprising:

a first module in said transfer device;

a second module in said transfer device;

driving means for driving said first and said second modules in a sequence with said press machine;

feeding means for feeding an external workpiece along a process direction of said press machine;

said feeding means extending from a bottom side of said driving means;

said feeding means cantilevered from a single side of said driving means;

said first module operating said feeding means along said process direction;

said second module operating said feeding means perpendicular to said process direction;

said driving means operating said first and second modules in said sequence to transport said external workpiece along said process direction whereby a speed of said transfer device increases and said transfer device is simplified and reduced in cost and size; said driving means is disposed on a first side of said press machine;

said first module operates said feeding means in a reciprocating advance-return motion along said process direction;

said second module operates said feeding means in a clamp-unclamp motion perpendicular to said process direction;

at least a first pair of feed bars in said feeding means;

slider means for slidably directing said feeding means in said advance-return motion;

at least a first bushing on said slider means;

a slider on said slider means;

said slider and said first bushing perpendicular to said feeding means;

at least a first guide shaft slidably supporting said first bushing and said slider in said process direction;

a first ball screw shaft;

said first ball screw shaft extending parallel to said feeding means;

a first nut on said slider;

said first nut threadably engaging said first ball screw shaft;

a first drive source in said first module;

said first drive source rotatably engaging said first ball screw shaft; and said first nut rotatively directing said slider in said advance-return motion whereby said external work piece processes along said process direction.

7. A transfer device according to claim 6, further comprising:

a cart means for slidably supporting said feeding means;

said cart means permitting slidable support of said first pair of feed bars during said advance return motion and conducting said clamp-unclamp motion whereby said external work piece processes along said process direction;

a first cart in said cart means;

a second cart in said cart means;

a second ball screw shaft joining said first and second carts;

said second ball screw shaft perpendicular to said feeding means;

said second ball screw shaft being reverse threaded at a midpoint to said process direction;

a second nut on each said first and second cart; each said second nut threadably engaging said second ball screw shaft;

a second drive source in said second module; and said second drive source rotatably engages said second ball screw shaft and rotatably controls each said first and second cart and said feeding means in said clamp-unclamp motion whereby said external work piece processes along said process direction.

8. A transfer device according to claim 7, further comprising:

a first end plate affixed to a first portion of said first cart;

a second end plate affixed to a first portion of said second cart;

a spring resiliently retained between each said second nut and each said first and said second end plate;

said second ball screw shaft extending through each said first and said second end plate and each respective said spring;

a first bracket;

a second bracket;

said first bracket and said second bracket affixed to each respective said first and second cart opposite each respective said first and second end plate; and said spring providing a spring force through said second nut to each respective said first and said second bracket whereby said spring resiliently urges each said second nut against each respective said first and second bracket.

9. A transfer device according to claim 8, further comprising:

sensor means for detecting a separation between at least one of said first bracket and said second bracket and at least one of each respective said second nut;

control means for controlling said press and said transfer device;

said sensor means producing a signal to said control means upon said separation; and said control means detecting said signal and stopping said press and said transfer device whereby damage to said driving means, said feeding means, and said press is eliminated and costs are reduced.

10. A transfer device for a press which conducts multiple processing steps along a process direction, comprising:

a drive mechanism;

a pair of feed bars cantilevered from a single side of said drive mechanism;

said feed bars cantilevered in said processing direction;

said feed bars extending below said drive mechanism;

said drive mechanism includes a first and second operating means;

said first operating means for operating said feed bars along said processing direction in an advance-return motion;

a second operating means for operating said feed bars perpendicular to said processing direction in a clamp-unclamp motion;

said drive mechanism being disposed on a first side of said press; and said feed bars process an external workpiece along said processing direction whereby said transfer device is simplified and reduced in size.

11. A transfer device according to claim 10, further comprising:

a slider slidably supporting said feed bars in said advance-return motion;

said slider including a bushing and a nut;

said slider and said bushing perpendicular to said feed bars;

at least one guide shaft slidably supporting said bushing and said slider in said advance-return motion;

a first ball screw shaft extending parallel to said feed bars;

said nut threadably engaging said first ball screw shaft; and a first drive source rotatably engages said first ball screw shaft and said nut and rotatively controls said slider in said advance-return motion whereby said external work piece processes along said process direction.

12. A transfer device according to claim 11, further comprising:

a cart slidably supports each said feed bar in said advance-return motion;

a second ball screw shaft extending perpendicular to said feed bars to each said cart;

said second ball screw shaft being reverse threaded at a midpoint to said process direction;

a second nut on each said cart;

said second nuts threadably engaging said second ball screw shaft; and a second drive source rotatably engages said second ball screw shaft and said second nuts rotatably controls said carts and said feed bars in said clamp-unclamp motion whereby said external work piece processes along said process direction.

13. A transfer device according to claim 12, further comprising:

an end plate affixed to an inside portion of each said cart;

a spring resiliently retained between each said second nut and each said end plate;

said second ball screw shaft extending through each said end plate and each said springs;

a first bracket affixed to said cart opposite each said end plate; and said springs urging a spring force through said second nut to said first bracket whereby said second nut is resiliently urged against said first bracket.

14. A transfer device according to claim 13, further comprising:

a sensor;

a control means permitting control of said press and said transfer device;

said sensor detecting a separation between said first bracket and said second nut;

said sensor producing a signal to said control means on said separation; and said control means detecting said signal and stopping said press and said transfer device whereby damage to said drive mechanism and said feed bars is eliminated and costs are reduced.

15. A transfer device, for use in press that conducts pressing by a plurality of processing steps along a feed direction, comprising:

a first and a second feed bar extending parallel to a feed direction;

a plurality of drive modules connected to said feed bars;

said plurality of drive modules being effective to drive said feed bars;

said feed bars transporting a workpiece;

said plurality of drive modules supporting only one end of said feed bars;

a unit case that internalizes said drive mechanism modules;

said unit case mounted on only one side surface of said press; and said unit case mounted above said feed bars whereby said transfer device is made smaller, at a reduced cost, while increasing precision and efficiency.

16. A transfer device, according to claim 15, further comprising:

one of said drive modules includes an advance-return drive module;

another of said drive modules includes a clamp-unclamp drive module;

said advance-return drive module operating said feed bars along said feed direction;

said clamp-unclamp drive module operating said feed bars perpendicular to said feed direction; and said plurality of drive modules permitting coordination of said advance-return drive module and said clamp-unclamp drive module whereby transfer device moves an external work piece along said feed direction.

17. A transfer device, comprising:

a first and a second feed bar extending parallel to a feed direction;

a drive module connected to said feed bars;

said drive module being of effective to drive said feed bars;

said feed bars transporting a workpiece;

said drive module supporting one end of said feed bars;

a unit case that internalizes said drive mechanism module;

said unit case on one side surface of said press;

said unit case above said feed bars whereby said transfer device is made smaller, at a reduced cost, while increasing precision and efficiency;

said drive module includes an advance-return drive module;

said drive module includes a clamp-unclamp drive module;

said advance-return drive module operating said feed bars along said feed direction;

and clamp-unclamp drive module operating said feed bars perpendicular to said feed direction;

said drive module permitting coordination of said advance-return drive module and said clamp-unclamp drive module whereby transfer device moves an external work piece along said feed direction; and a slider that slidably supports said feed bars in said feed direction;

a bushing on said slider;

a guide shaft slidably joined to said bushing and said slider;

said guide shaft slidably supports said slider along said feed direction;

a first ball screw shaft;

a first nut on said slider;

said first nut threadably engages said first ball screw shaft; and a first drive source rotatably controlling said first ball screw shaft and said slider whereby said advance-return drive module operates and transfers said external work piece along said feed direction.

18. A transfer device, according to claim 17, further comprising:

at least one cart;

said cart slidably supports each said feed bars along said feed direction;

a second nut operably attached to each said cart;

a second ball screw shaft perpendicular to said feed direction;

said second ball screw shaft threadably engages each said second nut;

said second ball screw shaft reverse threaded about a center line of said feed direction; and a second drive source rotatably controlling said second ball screw shaft and each said cart whereby said clamp-unclamp module operates and transfers said external work piece along said feed direction.

19. A transfer device, according to claim 18, further comprising:

an end plate;

said end plate affixed to each said cart;

a spring on said second ball screw shaft;

said spring resiliently retained on between said each end plate and each said second nut;

a bracket;

said bracket affixed opposite said end plate on said cart;

said springs resiliently urging each said second nut against each said bracket; and a sensor being of effective to detect a separation of said second nut from said bracket and send a signal that stops said transfer device and said press whereby said transfer device and said press are protected from damage.

20. A transfer device, according to claim 19, wherein:

a coil feeder is on an upstream side of said press;

said transfer device is on a downstream side of said press; and said transfer device progressively transfers an external work piece from said coil feeder through said press to an offload station whereby said transfer device increases operational precision, minimizes operational costs, reduces the equipment size, and reduces waste material.

21. A transfer device for a press machine which conducts processing along a process direction, comprising:

a plurality of feeding means for feeding of an external workpiece along said process direction of said press machine;

first module means for operating said plurality of feeding means along said process direction;

second module means for operating said plurality of feeding means perpendicular to said process direction;

driving means for operating of said first and said second module means in sequence with said press machine;

said plurality of feeding means cantilevered from a single side of said driving means;

said plurality of feeding means disposed at a bottom side of said driving means; and said driving means operating said first and said second module means in sequence to transport said external workpiece along said process direction whereby a speed of said transfer device is increased and said transfer device is simplified and reduced in cost and size.

* * * * *